United States Patent [19]

Matsui et al.

[11] Patent Number: 4,686,935

[45] Date of Patent: Aug. 18, 1987

[54] DEVELOPING DEVICE

[75] Inventors: Toshikazu Matsui, Kishiwada; Akira Fushida, Suita; Nobuyasu Honda, Tenri; Minoru Nakao, Kashiba; Nobuyuki Tsuji, Kakogawa, all of Japan

[73] Assignee: Mita Industrial Co., Ltd., Osaka, Japan

[21] Appl. No.: 760,587

[22] Filed: Jul. 30, 1985

[30] Foreign Application Priority Data

Jul. 30, 1984 [JP] Japan ..... 59-157169

[51] Int. Cl.[4] ..... G03G 15/09

[52] U.S. Cl. ..... 118/658

[58] Field of Search ..... 118/658

[56] References Cited

U.S. PATENT DOCUMENTS 4,451,134 5/1984 Fukuchi et al. ..... 118/658 X 4,555,172 11/1985 Mogi ..... 118/658 X 4,557,992 12/1985 Haneda et al. ..... 118/658 X

*Primary Examiner*—Bernard D. Pianalto

*Attorney, Agent, or Firm*—Sherman and Shalloway

[57] ABSTRACT

Disclosed is a development device comprising a development sleeve of a non-magnetic material, a magnet having a plurality of magnetic poles and fixed within the sleeve, a mechanism for rotating the sleeve, a mechanism for agitating a developer composed of a magnetic carrier and a chargeable toner and supplying it to the sleeve, a mechanism for adjusting a magnetic brush formed on the sleeve to a predetermined brush length and supplying it to a development zone, and a mechanism for scraping off the magnetic brush which has gone past the development zone from the sleeve, said magnetic poles consisting of a main pole for development corresponding to the development zone and poles for conveying corresponding to a conveying zone ranging from the position of supplying the developer to the position of cutting the magnetic brush, said magnetic carrier being a ferrite carrier, and each said conveying magnetic pole having a magnetic flux density 50 to 86% of that of the main pole for development.

6 Claims, 4 Drawing Figures

DEVELOPING DEVICE

BACKGROUND OF THE INVENTION

1. Field of the Invention

This invention relates to a developing device in electrophotography, and more specifically, to a device for developing a latent electrostatic image by using a two-component developer composed of a ferrite carrier and an electrically chargeable toner.

2. Description of the Prior Art

In an electrophotographic device using a two-component magnetic developer, a chargeable toner and a magnetic carrier are mixed to form a two-component composition. The composition is supplied to a development sleeve having a magnet therein to form a magnetic brush composed of the composition. An electrophotographic plate bearing a latent electrostatic image is brought into rubbing contact with the magnetic brush to form a charged toner image on the photographic plate. By rubbing with the magnetic carrier, the toner is charged to a polarity opposite to the polarity of the charged electrostatic latent image on the photographic plate. Consequently, the charged toner particles on the magnetic brush adhere to the latent electrostatic image by the Coulomb's force to develop the latent electrostatic image to a visible image. On the other hand, the magnetic carrier is attracted to the magnet within the sleeve, and the polarity of its charge is the same as the polarity of the charged latent electrostatic image. Hence, the magnetic carrier remains on the sleeve.

Generally, an iron powder carrier is widely used as the magnetic carrier, but the iron powder carrier still has many defects. A two-component developer containing the iron powder carrier has the defect that the rising of the development sensitivity curve (a curve showing the relation of the density of an image to the potential between the latent electrostatic image and the development sleeve) is steep, and the image has an inferior gradation and a poor reproducibility of a halftone. Furthermore, the developer containing the iron powder carrier sometimes forms a hard magnetic brush and may possibly injure the photosensitive layer. Moreover, in copying a solid portion, brush marks, which are many rows of short and slender white lines extending in the rubbing direction of the brush, are seen to form. Another disadvantage is that the iron powder carrier is sensitive to humidity, and its development characteristics may change under the influences of humidity. Or rust tends to occur in the iron powder carrier itself.

To remedy these defects, the use of ferrite, particularly soft ferrite, as the magnetic carrier has recently been proposed. Since, however, the ferrite carrier is very different from the iron powder carrier in particle characteristics and magnetic properties, the developing conditions used with the iron powder carrier cannot be applied directly. For example, the iron powder carrier consists of irregularly-shaped particles, whereas the ferrite carrier is composed of nearly spherical particles. Furthermore, the ferrite carrier has a lower permeability than the iron powder carrier. For this reason, a two-component magnetic developer containing the ferrite carrier forms a magnetic brush having a smaller brush length than the developer containing the iron powder carrier. Thus, a toner image of good quality cannot be obtained unless the brush length is considerably shortened. When the brush length of the two-component magnetic developer containing the ferrite carrier is so shortened, the rotation of the development sleeve requires an excessive torque which will cause deflection or vibration in the development device so that development cannot be performed well. Or the excessive torque also causes deflection to the optical unit.

SUMMARY OF THE INVENTION

It is an object of this invention to provide a development device for a ferrite carrier which is free from the aforesaid defects.

Another object of this invention is to provide a development device for a ferrite carrier in which a magnetic brush of a two-component developer is formed well in a development zone, and the magnetic brush is transported and cut smoothly with a low torque.

According to this invention, there is provided a development device comprising a development sleeve of a non-magnetic material, a magnet having a plurality of magnetic poles and fixed within the sleeve, a mechanism for rotating the sleeve, a mechanism for agitating a developer composed of a magnetic carrier and a chargeable toner and supplying it to the sleeve, a mechanism for adjusting a magnetic brush formed on the sleeve to a predetermined brush length and supplying it to a development zone, and a mechanism for scraping off the magnetic brush which has gone past the development zone from the sleeve, said magnetic poles consisting of a main pole for development corresponding to the development zone and poles for transportation corresponding to a transportation zone from the position of supplying the developer to the position of cutting the magnetic brush, said magnetic carrier being a ferrite carrier, and each said magnetic pole for transportation having a magnetic flux density 50 to 86% of that of the main pole for development.

DETAILED DESCRIPTION OF PREFERRED EMBODIMENTS

With reference to the accompanying drawings, the invention will be described below in detail.

Figure 1:
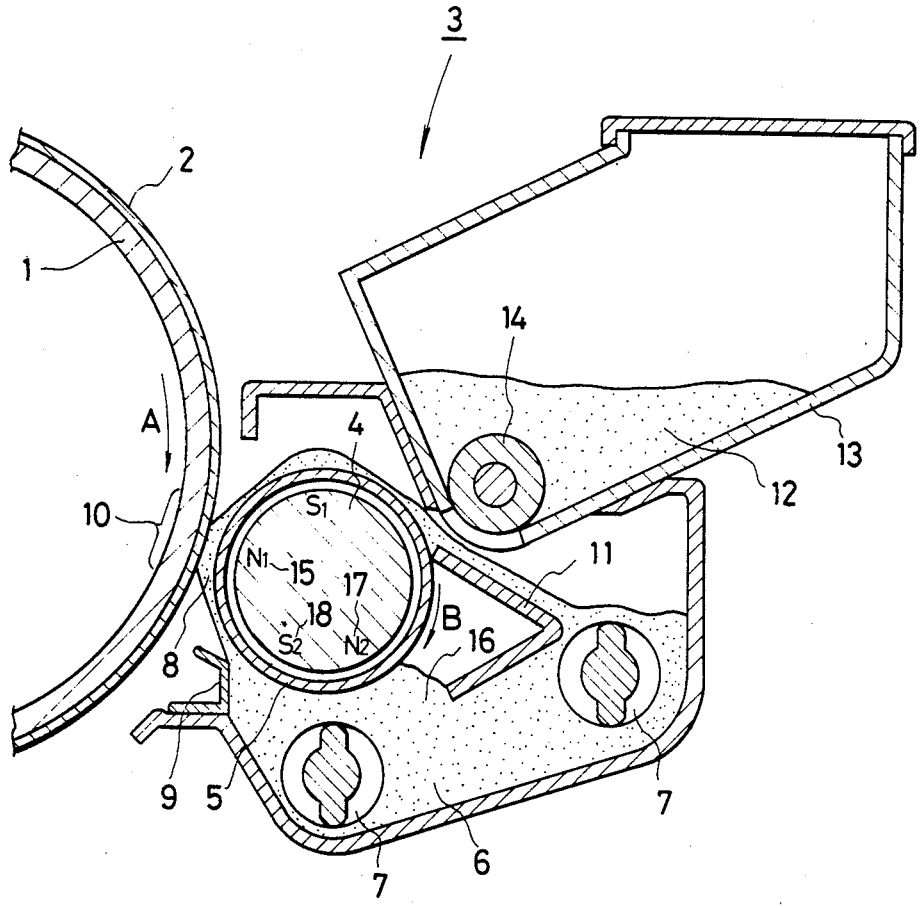
FIG. 1 is an outline view of one embodiment of the development device of this invention.

In FIG. 1 showing the general arrangement of the development device of this invention together with a photosensitive layer, a photosensitive layer 2 such as a selenium-type photoconductor layer is formed on the surface of a drum 1 to be driven in the direction of arrow A. A latent electrostatic image is formed on the surface of the photosensitive layer 2 by such means as uniform charging and imagewise exposure, although this is not shown in the drawing.

Along the moving path of the photosensitive layer 2, a development device shown generally at 3 is provided.

The device 3 includes a magnet 4 having a plurality of magnetic poles and a sleeve 5 of a non-magnetic material such as aluminum provided around the magnet 4. The sleeve 5 is rotatable in the direction of arrow B, and the magnet 4 is fixed within the sleeve 5. An agitating mechanism 7 is disposed to agitate a two-component developer 6. The agitating mechanism mixes a ferrite carrier and chargeable toner particles. They are triboelectrically charged to form an electrostatically combined mixture. The mixture, or the two-component developer 6, is supplied to the sleeve 5.

The two-component developer forms a magnetic brush 8 on the sleeve 5, and the magnetic brush 8 is adjusted to a suitable brush length by a brush length adjusting mechanism 9 and supplied to a development zone 10. In the development zone 10, the photosensitive layer 2 and the sleeve 5 are moved in opposite directions to each other and the photosensitive layer 2 is brought into rubbing contact with the magnetic brush 8. As a result of rubbing, the charged toner particles on the ferrite carrier are attracted to the latent electrostatic image on the photosensitive layer to develop the latent electrostatic image. After the development, the magnetic brush is peeled off from the sleeve 5 by a scraper plate 11. The peeled two-component developer is agitated by the agitating mechanism 7 and again supplied to the sleeve 5. To supply the toner 12 consumed by the development, a toner receptacle 13 and a toner supply roller 14 are provided, and the toner 12 is continuously or intermittently supplied to the development device 3.

A driving mechanism such as a sprocket (not shown) is provided at one end portion of the sleeve 5, and is adapted to be driven in the direction of arrow B by a driving motor and a chain (not shown).

The clearance between the brush length-adjusting mechanism 9 and the sleeve 5, i.e. the length of the magnetic brush, is generally in the range of 0.8 to 1.2 mm in the case of using a ferrite carrier. This is much shorter than the brush length in the case of using an iron powder carrier which is generally within the range of 2.5 to 3.5 mm.

The magnetic poles in the magnet 4 consist of a main pole 15 for development provided at a position nearly opposite to the photosensitive layer 2 corresponding to the development zone 10, and magnetic poles 17 and 18 for conveying corresponding to a conveying zone ranging from the position 16 of supplying the developer to the brush length-adjusting mechanism 9. In the embodiment shown in FIG. 1, the magnetic pole 17 concurrently has the function of pulling up the developer onto the sleeve 5 and the magnetic pole 18 also has the action of forming the magnetic brush at the time of brush length adjustment.

In the present invention, the magnetic poles 17 and 18 for transportation have a magnetic flux density ($H_2$) 50 to 86%, especially 55 to 80%, of the magnetic flux density ($H_1$) of the main pole 15 for development in relation to the use of a ferrite carrier as the magnetic carrier of the two-component developer.

Figure 2:
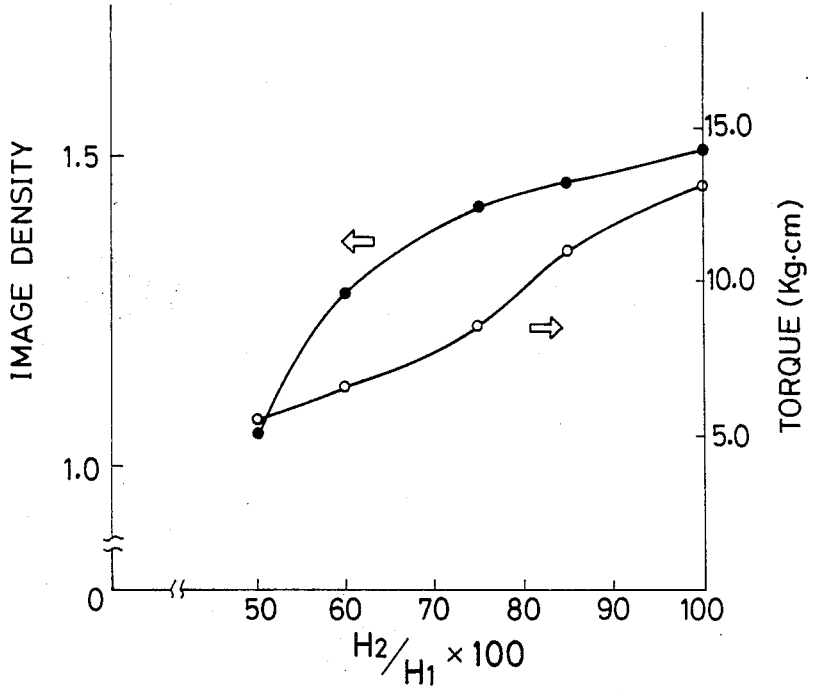
FIG. 2 is a graph showing the relation among the ratio of the magnetic flux density of a magnetic pole for transportation to that of a main pole for development, the torque of a development sleeve, and the density of an image.

FIG. 2 is obtained by varying the magnetic flux density ($H_2$) of the magnetic poles 17 and 18, and plotting the value of $H_2/H_1 \times 100$ (%) on the axis of abscissa, the torque (kg-cm) required for the rotation of the sleeve 5 on the right axis of ordinate and the image density of the resulting toner image on the left axis of ordinates. In the figure, white circles show the torque values and the black circles, the image densities.

The results plotted in FIG. 2 demonstrate that to adjust the magnetic flux density ($H_2$) of the magnetic poles 17 and 18 to not more than 86% of the magnetic flux density ($H_1$) of the main pole 15 is critical in limiting the driving torque of the sleeve to a level of not more than 8.5 kg-cm at which deflection or vibration of the development device does not substantially occur. It can also be seen from FIG. 2 that to adjust the magnetic flux density ($H_2$) of the magnetic poles 17 and 18 to at least 50% of the magnetic flux density ($H_1$) of the main pole 15 is very critical in maintaining a sufficient conveying speed of the magnetic brush for development and obtaining a sufficient image density. In addition, the present invention also achieves the advantage that by increasing the magnetic flux density ($H_1$) of the main pole 15 as compared with those of the magnetic poles 17 and 18, a sufficient brush length formation necessary for the development of a latent electrostatic image can be secured.

Generally, satisfactory results are obtained in this invention if the magnetic flux density ($H_1$) of the main pole 15 is within the range of 700 to 1000 gauss. The magnetic flux densities ($H_2$) of the magnetic poles 17 and 18 are determined so as to meet the aforesaid condition.

Figure 3:
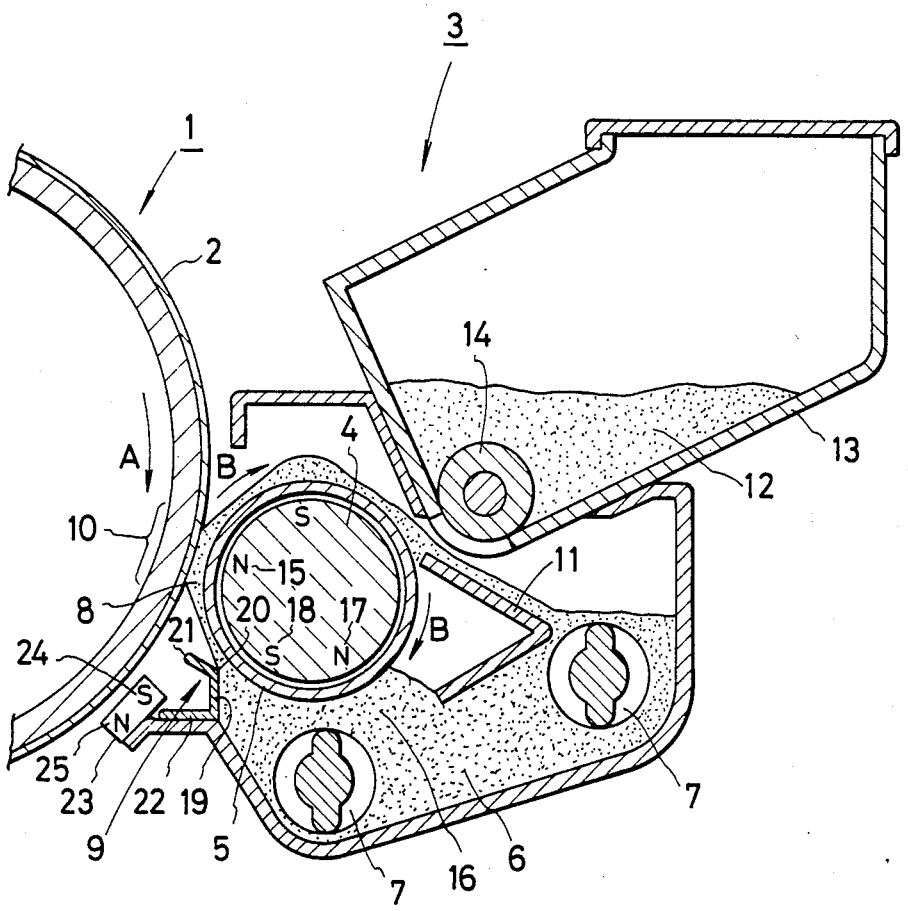
FIG. 3 is an outline view of another embodiment of the development device of this invention.

The embodiment shown in FIG. 3 may be employed in this invention in order to prevent adverse effects on an image which are attributed to the toner scattering in the development zone or the adhesion of the ferrite carrier to the photographic material, such as the contamination of a nonimage area (fogging) or the impairment of the quality of the image.

In this embodiment, too, the moving direction of the photosensitive layer 2 is downward (the direction of arrow A), and the moving direction of the sleeve 5 is upward (the direction of arrow B) so that the photosensitive layer 2 is brought into intimate rubbing contact with the magnetic brush 8. The brush length adjusting mechanism 9 is located below the development zone 10.

The brush length adjusting mechanism 9 is made of a non-magnetic material and has a L-shaped or ◎ -shaped cross section. It is comprised of a guide portion 19 permitting a gradually narrow distance from the sleeve 5, a tip 20 for brush cutting, an extension 21 following the tip 20 for preventing dropping off of the developer, and a portion 22 for securing to the developing device.

A magnet member 23 for removing the carrier is provided on the photographic layer delivering side of the brush length adjusting mechanism 9 so that a magnetic pole 24 of the magnetic member 23 which is on the photosensitive layer introducing side is of the same polarity as the magnetic pole 18 which is nearer to the brush length adjusting mechanism 9 and is of an opposite polarity to the main pole 15 for development. In the embodiment shown in FIG. 3, the main pole 15 is of N pole, and the magnetic pole 18 is of S pole, and correspondingly to it, the polarity of the magnet 24 of the magnet member 23 is adjusted to S. The magnet member 23 is formed preferably such that a magnetic pole which forms a pair is located along the photosensitive layer. The magnetic pole 25 on the photosensitive layer delivering side of the magnet member 23 is of N-pole.

According to this embodiment, by providing the magnet member 23 for removing a carrier on the photosensitive layer in the aforesaid relation with respect to a magnetic pole within the sleeve, scattering of the toner from the brush cutting portion or the development zone can be markedly prevented, and at the same time, the quality of the resulting image can be greatly improved.

The magnet used in the aforesaid embodiment may be a known magnet such as an ordinary metallic magnet, a ferrite magnet, or a rubber magnet obtained by dispersing a magnetic material in a rubbery binder.

Furthermore, by selectinig the magnetic flux density of the main pole 15 of the magnetic brush-forming sleeve 5 within a certain range in relation to the charge potential of the photographic layer, an image of a high density with an excellent reproducibility of halftones and fine lines can be formed without the occurrence of an edge effect or brush marks.

Figure 4:
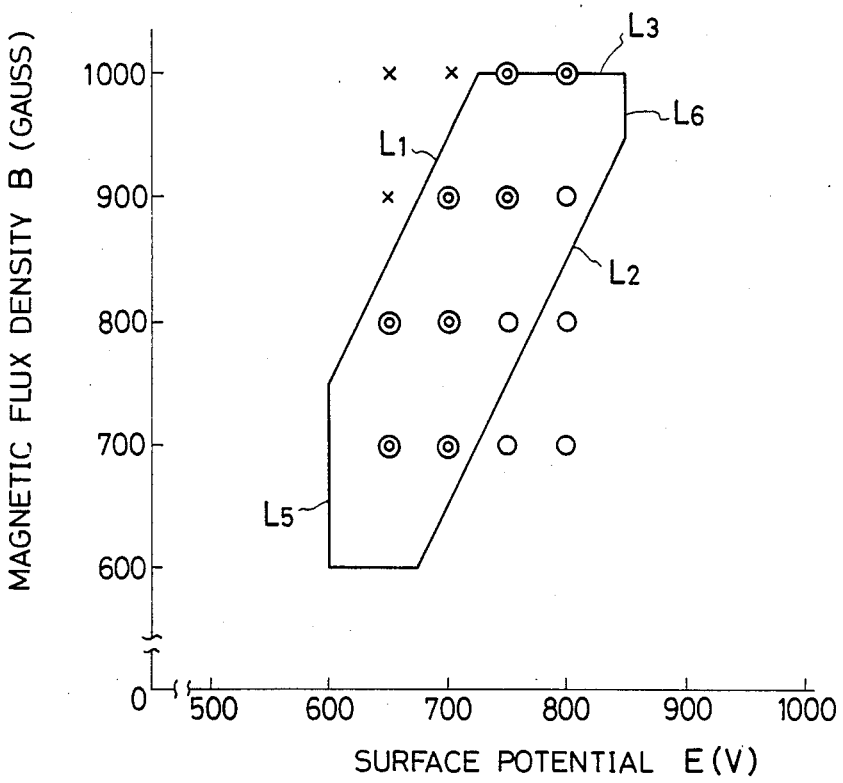
FIG. 4 is a graph showing the relation of the magnetic flux density B of the main pole for development and the surface potential E to the quality of the image formed.

FIG. 4 is obtained by plotting the quality of the resulting image with the magnetic flux density B of the main pole on the axis of ordinate and the surface potential E of the photosensitive layer on the axis of abscissa. The symbols in the figure have the following meanings.

◎ : The gamma-value is 1.4 to 1.6, and the quality of the image is excellent

X: The gamma-value is smaller than 1.4, or an edge effect or brush marks occur

○ : The gamma value is larger than 1.6.

The straight lines in FIG. 4 have the following meanings.

$L_1$: $B=2E-450$ $L_2$: $B=2E-750$ $L_3$: $B=1000$ $L_4$: $B=600$

The straight lines $L_1$ and $L_2$ determine the upper limits of the developing conditions in regard to the density of the resulting image or the quality of the image such as the edge effect or the formation of brush marks. On the other hand, the straight lines $L_3$ and $L_4$ define the lower limits of the developing conditions with regard to the reproducibility of halftones or fine lines.

The straight lines $L_5$ and $L_6$ have the following meanings.

$L_5$: $E=600$ $L_6$: $E=850$

The straight line $L_5$ determines the lower limit of the charge potential in regard to the density and contrast of an image formed on a selenium photosensitive plate. The straight line $L_6$ defines the upper limit of the charge potential in regard to the durability of the photosensitive plate. Of course, the straight lines $L_5$ and $L_6$ vary in value for different types of the photosensitive layer.

Thus, it is clear that in the case of a selenium-type photosensitive layer, a toner image having a high density, and an excellent gradation, resolution and image quality can be formed for a relatively broad range of surface potentials when $B \leqq 2E-450$ and $B \geqq 2E$ 750, and B is 700 to 900 gauss, and most preferably 800 to 900 gauss.

In the present invention, known ferrite carriers can be used. Particularly, sintered ferrite particles are preferred. The sintered ferrite particles are known, and particularly spherical sintered ferrite particles are advantageously used. The composition of ferrite is also known. What is generally called a soft ferrite may be used. Non-limitative examples are Zn-type ferrite, Ni-type ferrite, Cu-type ferrite, Mn-type ferrite, Mn-Zn-type ferrite, Mn-Mg-type ferrite, Cu/Zn-type ferrite, Ni/Zn-type ferrite and Mn-Cu-Zn-type ferrite. Suitable ferrites are Cu/Zn-type or Cu/Zn/Mn-type ferrites composed of 35 to 65 atomic weight % of Fe, 5 to 15 atomic weight % Cu, 5 to 15 atomic weight % of Zn and 0 to 0.5 atomic weight % of Mn.

The sintered ferrite particles used desirably have an average particle size diameter of generally 30 to 100 microns, particularly 35 to 45 microns.

The chargeable toner to be used has colorability and fixability as well as chargeability, and contains a resinous medium for fixing, a coloring pigment and a charge controlling dye as essential ingredients.

The fixing resin may be a thermoplastic resin or a thermosetting resin in the uncured state or in the form of an initial stage condensate. Suitable examples include, in order of decreasing importance, vinyl aromatic resins such as polystyrene, acrylic resins, polyvinyl acetal resins, polyester resins, epoxy resins, phenolic resins, petroleum resins, and olefin resins. As the coloring pigments one or more of carbon black, cadmium yellow, molybdenum orange, pyrazolone red, fast violet B and phthalocyanine blue may be used.

The toner particles have an average particle diameter of generally 9 to 15 microns, preferably 10 to 13 microns.

The ferrite carrier and the toner are mixed in a weight ratio of from 100:5 to 1000:14, and used in the developing device of this invention.

The following examples further illustrate the invention.

EXAMPLE 1

In the development device shown in FIG. 1, the magnet 4 composed of developing main pole 15 ($N_1$), conveying magnetic pole 17 ($N_2$) and conveying magnetic pole 18 ($S_1$) was used. Five types of magnet rolls consisting of these poles with different magnet strengths were prepared (see Table 1).

TABLE 1

| Type | Pole $N_1$ (gauss) | Pole $N_2$ (gauss) | Pole $S_1$ (gauss) | $H_2/H_1 \times 100$ (*1) |
|---|---|---|---|---|
| A | 100 | 1000 | 1000 | 100 |
| B | 1000 | 900 | 800 | 85 |
| C | 1000 | 900 | 600 | 75 |
| D | 1000 | 600 | 600 | 60 |
| E | 1000 | 500 | 500 | 50 |

(*1): $H_2/H_1 = (N_2 + S_1)/2N_1$

Each of the magnets shown in Table 1 was mounted on the development device shown in FIG. 1, and the torque on the development sleeve and the quality of the image were examined.

The two-component developer and the developing conditions used were as follows:

Two-component developer

Carrier (ferrite)

Saturation magnetization: 60 emu/g

Residual magnetization: 0.3 emu/g

Coercive force: 3 oersted

Average particle diameter: 45 microns

Toner

Average particle diameter: 12 microns

Mixing Ratio: Carrier:toner=100:11

Developing conditions

Drum-sleeve distance: 1.6 mm

Peripheral speed ratio (S/D): 1.8 (the sleeve speed=160 mm/S)

Brush length: 1.0 mm

The results are shown in Table 2.

TABLE 2

| Type | Torque (kg-cm) | Test items: Blurring of the image | Carrier scattering | Uniformity of halftones | Image density | Overall evaluation |
|---|---|---|---|---|---|---|
| A | 13 | X | X | ○ | 1.502 | X |
| B | 11 | X | Δ | ○ | 1.456 | Δ |
| C | 8.5 | Δ | ○ | ○ | 1.413 | ○ |
| D | 6.5 | ○ | ○ | ○ | 1.278 | ○ |
| E | 5.5 | ○ | ○ | Δ | 1.053 | Δ |

○: Good (did not occur)
Δ: Slightly good (slightly occurred)
X: Poor (considerably occurred)

EXAMPLE 2

The magnet intensities of the conveying poles 17 and 18 of the magnet 4 of the development device shown in FIG. 1 were set at 550 gauss, and the magnet intensity of the developing main pole 15 and the surface potential were changed as indicated in Table 3.

The results are shown in Table 3.

TABLE 3

| Magnet intensity (gauss) | Surface potential E(V) | Image density | Fog density | $\bar{\gamma}$ value | Edge effect | Brush marks | Remarks | Image quality |
|---|---|---|---|---|---|---|---|---|
| 700 | 650 | 1.382 | 0.004 | 1.55 | ○ | ○ | | ◎ |
| | 700 | 1.412 | 0.004 | 1.61 | ○ | ○ | | ◎ |
| | 750 | 1.416 | 0.003 | 1.76 | ○ | ○ | | ○ |
| | 800 | 1.444 | 0.004 | 1.86 | ○ | ○ | | ○ |
| 800 | 650 | 1.377 | 0.000 | 1.51 | ○ | ○ | | ◎ |
| | 700 | 1.399 | 0.001 | 1.52 | ○ | ○ | | ◎ |
| | 750 | 1.426 | 0.001 | 1.83 | ○ | ○ | | ○ |
| | 800 | 1.426 | 0.001 | 1.82 | ○ | ○ | | ○ |
| 900 | 650 | 1.318 | 0.001 | 1.28 | X | ○ | The end | X |
| | 700 | 1.399 | 0.002 | 1.46 | ○ | ○ | was | ◎ |
| | 750 | 1.423 | 0.001 | 1.61 | ○ | ○ | missing | ◎ |
| | 800 | 0.430 | 0.001 | 1.76 | ○ | ○ | | ○ |
| 1000 | 650 | 1.269 | 0.002 | 1.19 | X | X | | X |
| | 700 | 1.370 | 0.001 | 1.41 | X | ○ | | X |
| | 750 | 1.426 | 0.001 | 1.48 | ○ | ○ | | ◎ |
| | 800 | 1.402 | 0.002 | 1.49 | ○ | ○ | | ◎ |

○ : Did not occur
X: occured

From the data in the above table, the surface potentials E(V) (the abscissa) and the magnet intensities (gauss) (the ordinate) were taken, and the qualities of the image on the individual points were plotted.

◎ : The gamma value is 1.4 to 1.6 and the quality of the image is good.

○ : The gamma-value is more than 1.6

X: The gamma value is less than 1.4, and an edge effect and brush marks occurred.

What is claimed is:

1. In a development device comprising a development sleeve of a non-magnetic material, a magnet having a plurality of magnetic poles and fixed within the sleeve, a mechanism for rotating the sleeve, a mechanism for agitating a developer composed of a magnetic carrier and a chargeable toner and supplying it to the sleeve, a mechanism for adjusting a magnetic brush formed on the sleeve to a predetermined brush length and supplying it to a development zone, and a mechanism for scraping off the magnetic brush which has gone past the development zone from the sleeve, said magnetic poles consisting of a main pole for development corresponding to the development zone and poles for conveying corresponding to a conveying zone ranging from the position of supplying the developer to the position of cutting the magnetic brush, the improvement wherein said magnetic brush is composed of said magnetic carrier, which is a ferrite carrier and said chargeable toner, and each said magnetic pole for conveying has a magnetic flux density 55 to 80% of that of the main pole for development.

2. The development device of claim 1 wherein the torque required for the rotation of sleeve is not more than 8.5 kg-cm.

3. The development device of claim 1 wherein the main pole for development has a magnetic flux density in the range of 700 to 1,000 gauss.

4. The development device of claim 1 wherein the ferrite carrier is in the form of spherical sintered ferrite particles.

5. The development device of claim 4 wherein the ferrite carrier particles have an average particle diameter of 30 to 100 microns, particularly 35 to 45 microns.

6. The development device of claim 4 wherein the ferrite carrier particles are Cu/Zn/Mn-type ferrite particles.

* * * * *